United States Patent [19]

Hyde

[11] Patent Number: 4,478,575

[45] Date of Patent: Oct. 23, 1984

[54] BLAST FURNACE STOVE OUTLET

[75] Inventor: Jack Hyde, Pittsburgh, Pa.

[73] Assignee: Raymond Kaiser Engineers Inc., Oakland, Calif.

[21] Appl. No.: 510,262

[22] Filed: Jun. 30, 1983

Related U.S. Application Data

[63] Continuation-in-part of Ser. No. 322,867, Nov. 19, 1981, abandoned.

[51] Int. Cl.[3] ..... C21B 9/00; F28C 3/10

[52] U.S. Cl. ..... 432/217

[58] Field of Search ..... 432/217

[56] References Cited

U.S. PATENT DOCUMENTS 1,835,074 12/1931 McKee .

2,420,373 5/1947 Hogberg ..... 263/19

3,802,833 4/1974 Weber ..... 432/247

4,201,543 5/1980 Hyde ..... 432/217

4,375,956 3/1983 Brandenburg et al. ..... 432/76

*Primary Examiner*—John J. Camby

*Attorney, Agent, or Firm*—Flehr, Hohbach, Test, Albritton & Herbert

[57] ABSTRACT

A blast furnace stove having a hot blast outlet which is configured in a particular elliptical-shaped so that all the bricks in its peripheral refractory reinforcing wall are substantially identical in shape and dimension. The center line of this outlet passes through the center of the blast furnace stove instead of through the center of the combustion chamber. Preferably, the burner inlet is also configured in the shape disclosed by the present invention.

18 Claims, 16 Drawing Figures

BLAST FURNACE STOVE OUTLET

CROSS REFERENCE TO RELATED APPLICATION

This is a continuation-in-part of a copending application Ser. No. 322,867, filed Nov. 19, 1981, now abondoned.

BACKGROUND OF THE INVENTION

1. Field of the Invention

The present invention relates to regenerative heaters and, in particular, to blast furnace stoves.

2. Description of the Prior Art

The preheating of air for blast furnaces is conventionally carried out in adjacent regenerative heaters known as blast furnace stoves. These stoves usually consist of a cylindrical refractory wall having a steel jacket and an internal vertical wall which partitions the stove into a combustion chamber and a checker chamber containing checkerbricks. A mixture of air and fuel is introduced through a burner inlet into the combustion chamber for burning and resultant combustion gases flow first upwardly from the combustion chamber over the vertical partitioning wall, and then downwardly through the checker work chamber until they are finally exhausted at the base of that chamber. After the checkerbricks have reached a sufficiently high temperature, the direction of fluid flow in the stove is reversed. A cold blast is introduced at the base of the checker chamber, and after absorbing heat from the checkerbricks this air passes over the wall and through the combustion chamber until it leaves the stove through a hot blast outlet in the shell of the stove.

Because of the high temperatures present at the hot blast outlet and the burner inlet, these apertures are generally peripherally surrounded by a reinforcing refractory wall consisting of one or more rings of refractory bricks. Heretofore, the shape of this wall has generally been a closed complex curve. In particular, the longitudinal, horizontal center line of such wall has passed through a point at the center of the combustion chamber rather than through the center of the blast furnace stove, itself. It has been found, however, that the building of such a complexly shaped wall into the curved surface of a stove requires a large variety of brick shapes. Consequently, the construction of these walls has proven to be an expensive and time consuming undertaking. It is, therefore, the object of the present invention to provide a peripheral reinforcing wall for a hot blast outlet or a burner inlet which may be economically constructed of a minimal number of brick shapes.

SUMMARY OF THE INVENTION

The present invention is a blast furnace stove which has an elliptical hot blast outlet with a peripheral elliptical reinforcing wall. More particularly, the shape of these apertures is that of a circle superimposed on the particular curved plane, usually a cylinder, which forms the lateral surface of the blast furnace stove. The center line of this outlet will pass through the center of the stove, itself, rather than through the center of the combustion chamber. It is found that the peripheral reinforcing wall surrounding such an aperture can be constructed of a single brick shape. Preferably, the burner inlet and its peripheral reinforcing wall are also elliptical in shape.

BRIEF DESCRIPTION OF THE DRAWINGS

The present invention is further described in the accompanying drawings in which.

DETAILED DESCRIPTION

Figure 1:
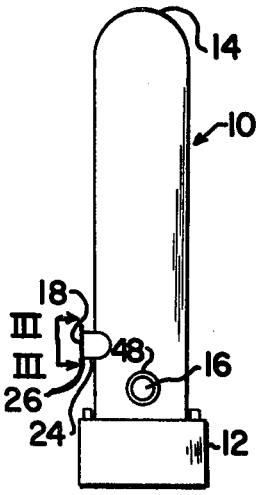
FIG. 1 is a side elevational view of a blast furnace stove.
Figure 2:
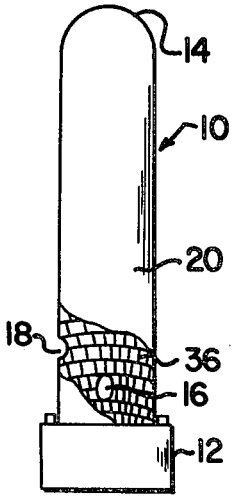
FIG. 2 is a cut away side elevational view of the blast furnace stove shown in FIG. 1.

A blast furnace stove is shown generally at numeral 10 in FIGS. 1 and 2. The stove is generally cylindrical and is supported on a lower base 12, and at its top it has a dome 14. Also shown are two apertures in the stove wall known as the burner inlet 16 and and the hot blast outlet 18. Except for certain features of the construction of its burner inlet and hot blast outlet which will be detailed below, this stove is of the usual kind, the structure and operation of which are well known and are described, for example, in U.S. Pat. No. 2,420,373. Briefly, however, it is noted that the burner inlet allows intimately mixed fuel and air to be introduced into the combustion chamber (not shown) wherein combustion products are formed to heat checkerbricks in the adjacent checker chamber (not shown). When the direction of gas flow in the stove is reversed, air that has been heated in the checker chamber and then introduced into the combustion chamber will be discharged to a blast furnace (not shown) by way of the hot blast outlet 18. It is also noted that while the burner inlet 16 is typically angularly displaced from the hot blast outlet, it may not be necessary to position these two apertures as far apart as is shown in FIGS. 1 and 2. In these figures, the burner inlet and hot blast outlet are shown as being displaced from each other by 90° so as to most clearly illustrate the present invention, but stove performance or construction considerations may warrant using a somewhat smaller angle between these apertures.

Figure 3:
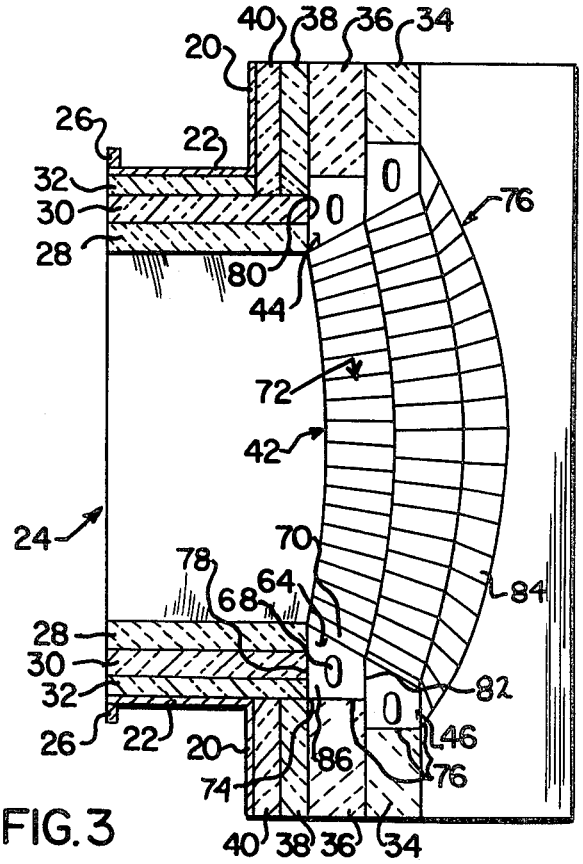
FIG. 3 is an enlarged view of a hot blast outlet in vertical section taken through line III—III in FIG. 1.

The area around the hot blast outlet is shown in FIG. 3 from which it will be seen that the stove has an outer steel jacket 20 which connects with a similar steel jacket 22 on a duct 24. This duct has a steel flange 26 and an inner refractory brick layer 28, an intermediate insulating brick layer 30 and an outer insulating block layer 32 which underlies the abovementioned steel jacket 22. Also shown in FIG. 2 is the refractory skin wall 34 which surrounds the combustion chamber of the stove and the shell wall 36 which underlies the stove's steel jacket and forms its refractory lining. Between the shell wall 36 and the steel jacket 22, there is also a layer of insulating brick 38 and a layer of insulating block 40. Finally, in FIG. 3 the hot blast outlet reinforcing wall is shown generally at 42. This wall is made up of an outer ring 44 and an inner ring 46. It will be observed that because of the unique shape of this wall, all the bricks in the inner ring are dimensionally indentical to one another. In the same way, all bricks in the outer ring are also dimensionally identical to one another. While not illustrated in detail, the area around the burner inlet 16 is substantially identical to that around the hot blast outlet 18, as illustrated in FIG. 3. The hot blast outlet 16 has, for example, a steel jacketed duct having, as shown in FIG. 1, a terminal flange 48. The cut away portion of FIG. 2 reveals that when this circularly cross sectional duct is removed, the burner inlet 16 is shown to be ellipitical in shape when viewed from the front of the stove. The hot blast outlet 18 is similarly ellipitical in shape.

Figure 4:
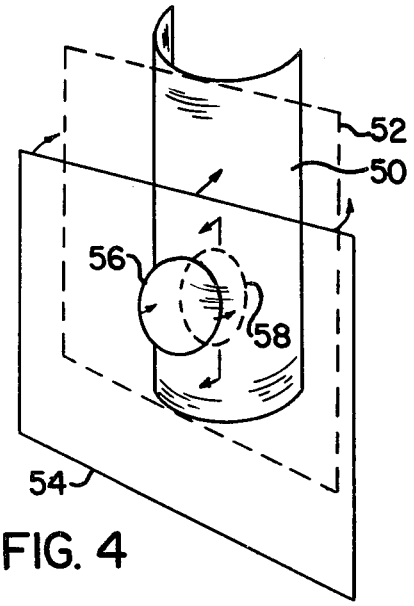
FIGS. 4 and 5 are perspective schematic views of the curved surface of a blast furnace stove.
Figure 5:
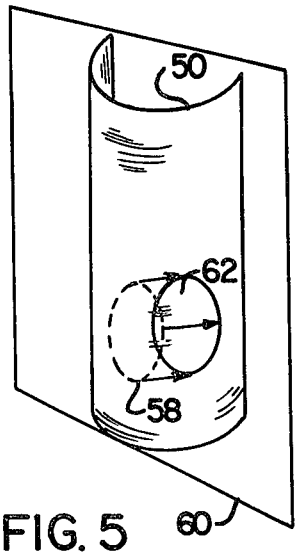

So as to define the use of the term 'elliptical' in the context of this description and to more clearly explain the shape of the hot blast outlet and the burner inlet, reference is made to FIGS. 4 and 5. In FIG. 4 there is shown a curved plane 50, a flat plane that is tangential to said curved plane and is shown in broken lines at numeral 52, and a flat plane 54 spaced from and parallel to the flat plane 50. The curved plane 50 schematically represents a portion of a curved surface of a blast furnace stove. Generally, this curved surface will be a portion of a cylinder, but it need not be. On flat surface 54, there is a circle 56. The shape of the hot blast outlet and the burner inlet in the blast furnace stove of the present invention is that shape shown at numeral 58 where the flat plane is moved toward curved plane 50 and is then, so to speak, wrapped around curved plane 50 so that the circle 56 is superimposed on said curved plane to form shape 58. While it is recognized that shape 58 is circular with respect to the curved plane 50, it will appear to be an ellipse when viewed in two dimensions from its front, and it will form an ellipse when it is projected perpendicularly onto a flat plane. Accordingly, such a shape will hereafter be referred to by the terms 'ellipse' and 'elliptical'. In FIG. 5, for example, shape 58 in curved plane 50 is projected onto flat plane 60 through a space, the sides of which, perpendicularly intersect flat plane 60. The shape projected on flat plane 60 is ellipse 62.

One of the bricks 64 in the inner ring is shown in detail in FIGS. 6–9. From these figures, it will be seen that this brick is equipped on one side with a tongue 66 (shown in broken lines in FIG. 6), which engages a groove on an adjoining brick. The brick is also equipped on the other side with a groove 68 (shown in broken lines in FIG. 7 and 8) that engages a tongue on the brick adjoining it to the other side.

Referring to FIGS. 6–9 and also to FIG. 3, it is further shown that the brick 64 has an inner side 70 which makes up part of an inner peripheral side 72 (FIG. 3) of the wall 42, itself. This inner peripheral side 72 (FIG. 3) is adjacent to the hot blast outlet aperture. The brick 64 also has an outer side 74 which makes up part of an outer peripheral side 76 (FIG. 3) of the wall 42. This outer peripheral side 76 abuts the skin wall 34 and the shell wall 36. Facing the exterior of the stove on the brick 64 is an exterior end 78 which makes up a part of the larger exterior end 80 (FIG. 3) of the entire wall 42. On the opposite side of brick 64 facing the interior of the stove is interior end 82 (FIG. 3). In the bricks in the interior ring 46, the surface corresponding to interior end 82 would form a part of the interior end 84 (FIG. 3) of wall 42. This interior end 84 faces the interior of the stove.

It will also be observed from FIG. 3 and FIGS. 6–9 that from the exterior end 80 to the interior end 84 of wall 42, the inner peripheral side 72 flares radially outwardly. As is shown particularly in FIG. 6, the angle a between the exterior end 78 of brick 64 and its inner side 70 is about 60°. An angle of this size will be found in the corresponding position between the exterior end 80 and the inner peripheral side 72 of all bricks making up the exterior ring 44.

Figure 6:
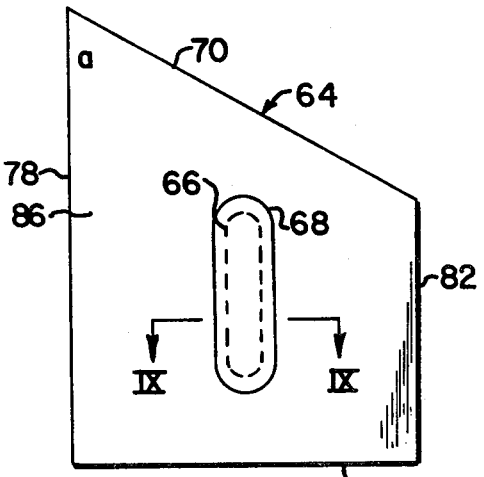
FIG. 6 is a front elevational view of a brick used in the hot blast outlet shown in FIG. 3.
Figure 7:
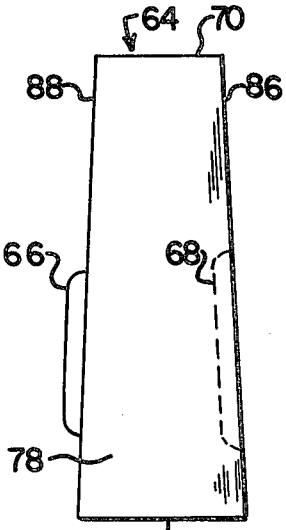
FIG. 7 is a side elevational view of the brick shown in FIG. 6.
Figure 8:
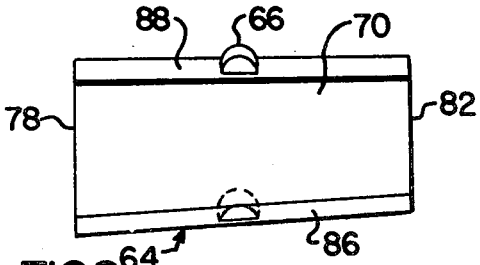
FIG. 8 is a plan view of the brick shown in FIG. 6.
Figure 9:
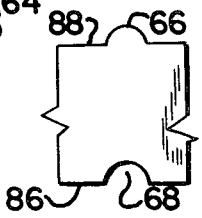
FIG. 9 is a fragmented cross sectional view along line IX—IX in FIG. 6.
Figure 10:
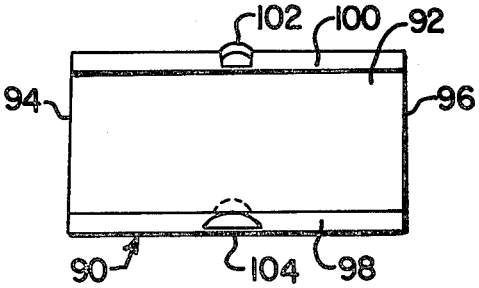
FIG. 10 is a plan view of another brick which may be used in conjunction with the brick shown in FIG. 6.

Referring particularly to FIGS. 6–8, it will be seen that the brick 64 has a pair of lateral sides 86 and 88 that abut similar lateral sides in adjoining bricks in exterior ring 44. It will also be observed that from the outer side 74 to the inner side 70 and from the exterior end to the interior end the lateral sides 86 and 88 are flared inwardly toward each other. It is found that a particular number of bricks similar to brick 64 will produce an elliptical ring of a particular constant size, but that the size of this elliptical ring may be varied by interspacing with bricks similar to brick 64 one or more bricks having a configuration similar to brick 90 which is shown in FIG. 10. Like brick 64, brick 90 has an inner side 92, an outer side (not shown), an exterior end 94, an interior end 96, and a pair of lateral sides 98 and 100. Like brick 64, brick 90 also has a tongue 102 and a groove 104 on its opposite lateral sides so as to allow it to be connected to adjacent bricks in the rings. It will be further observed that brick 90 is dimensionally similar to brick 64 except that its lateral sides 98 and 100 are perpendicular to its exterior end 94 and interior end 96 instead of being flared inwardly with respect to those ends. By using one or more bricks such as brick 90 in an elliptical ring consisting in part of bricks such as brick 64, the size of the ring may be varied while retaining the ring's elliptical shape.

Figure 11:
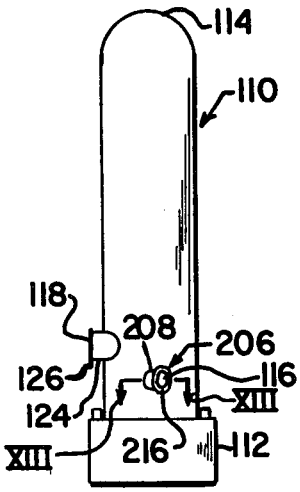
FIG. 11 is a side elevational view of a blast furnace stove showing a second embodiment of the present invention.
Figure 12:
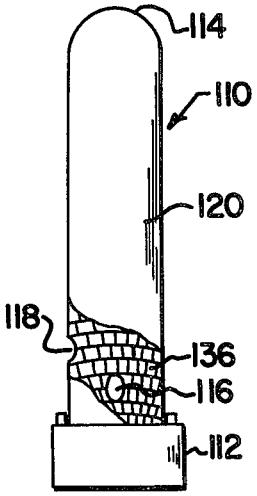
FIG. 12 is a cut away side elevational view of the blast furnace stove shown in FIG. 11.
Figure 13:
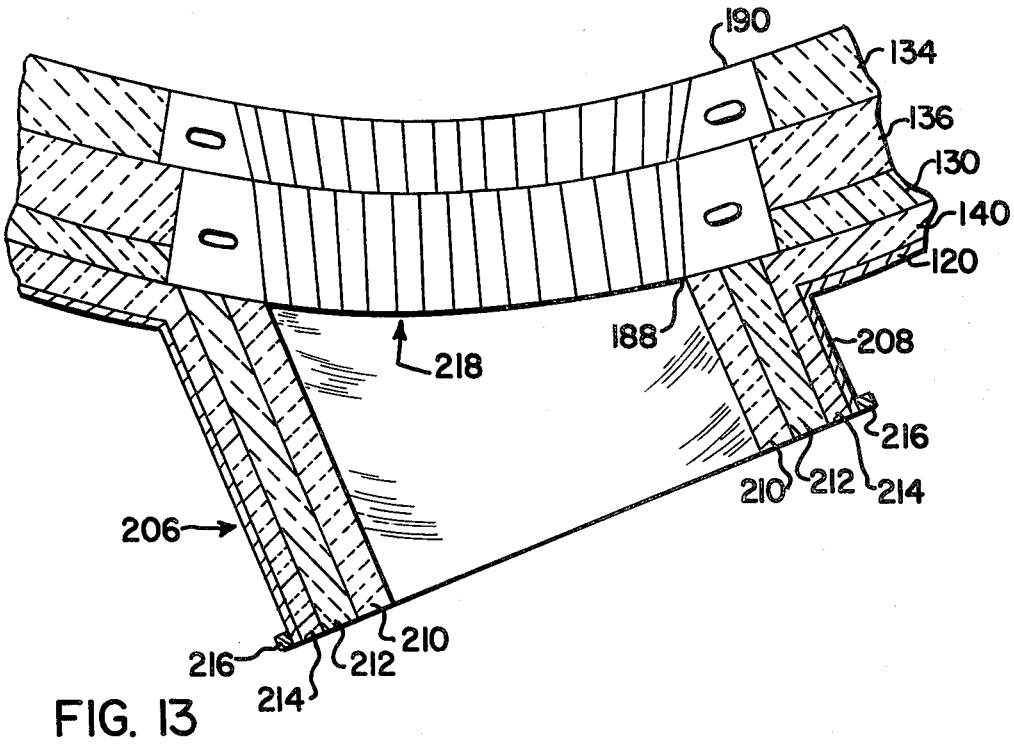
FIG. 13 is an enlarged view of a burner inlet in horizontal section taken through line XIII—XIII in FIG. 11.

By means of the present invention it is also possible to easily skew the hot blast outlet or burner inlet duct. It will be appreciated that an existing blast furnace stove will often be positioned so that its hot blast outlet and burner inlet ducts are skewed relative to the exterior surface of the furnace rather than extending radially from it. FIGS. 11–13 show that it is possible to rebuild a reinforcing wall around an existing hot blast outlet or burner inlet and to use an elliptically shaped wall with bricks which are substantially similar in shape rather than the plurality of brick shapes which had been used on the previous reinforcing wall. In FIGS. 11 and 12 a blast furnace stove is shown generally at numeral 110. This stove is supported on a base 112, and it has a dome 114. It is also equipped with a burner inlet 116 and a hot blast outlet 118. The hot blast outlet 118 has a radially projecting duct 124 having a terminal flange 126. The burner inlet 116 also has cylindrical duct 206. It will be observed that the burner inlet duct 206 is skewed, or that it projects from the curved surface of the stove at an acute angle. Referring particularly to the cut-away section of FIG. 12, it will be seen that the burner inlet aperture 116 is elliptical in shape. The skewed orientation of the burner inlet duct is more clearly shown in FIG. 13 in which it will be seen that the outer steel jacket 120 which connects with a similar steel jacket 208 on the duct 206. The duct 206 also has an inner refractory brick layer 210, and intermediate insulating brick layer 212, and an outer insulating block layer 214 which underlies the above mentioned steel jacket 208. The steel jacket 208 also has a terminal flange 216. FIG. 13 also shows the refractory skin wall 134 and the shell wall 136 of the stove, as well as a layer of insulating brick 138 and a layer of insulating block 140 which are interposed between the shell wall and the steel jacket. The burner inlet reinforcing wall is shown generally at 218. This wall is made up of an outer ring 188 and an inner ring 190. This wall is elliptical in shape and all the bricks rings 188 and 190 have dimensions which are substantially identical to bricks in the same ring. It will be observed that because of this elliptical shape, the duct 206 could be arranged to project from the surface of the stove 110 and abut the wall 218 at a wide variety of acute angles.

Figure 14:
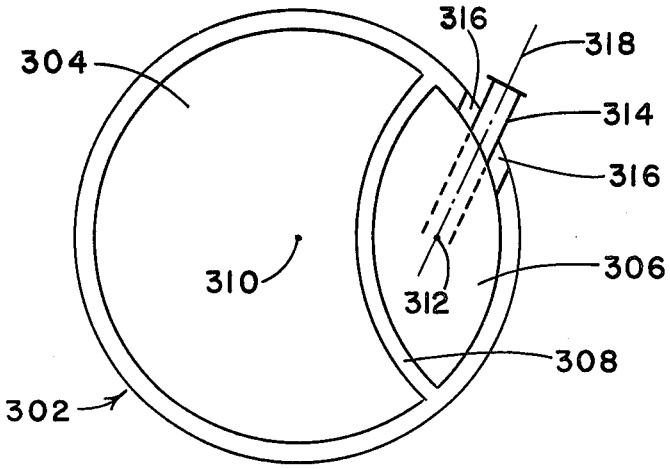
PRIOR ART FIG. 14
FIG. 14 is a schematic illustration of a blast furnace stove in horizontal section showing the positioning of a hot blast outlet as was conventional in the prior art.
Figure 15:
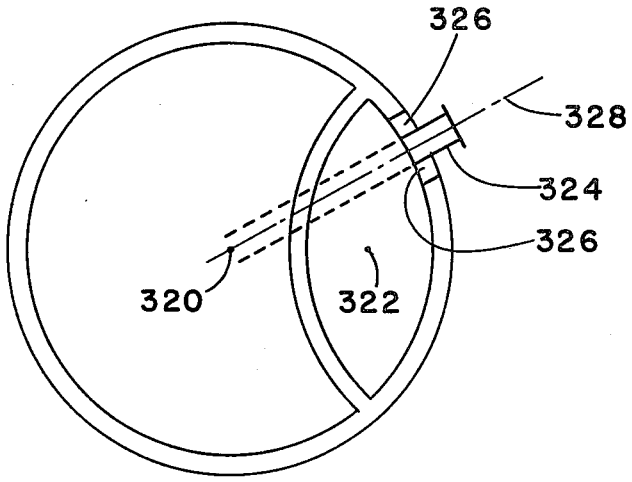
FIG. 15 is a schematic illustration of a blast furnace stove in horizontal section showing the positioning of a hot blast outlet in a stove similar to the one shown in FIGS. 1-3.
Figure 16:
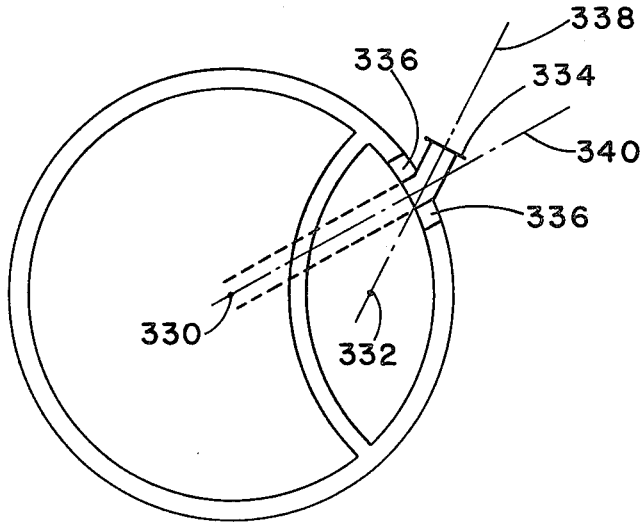
FIG. 16 is a schematic illustration of a blast furnace stove in horizontal section showing the positioning of a hot blast outlet in a stove similar to the one shown in FIGS. 11-13.

The above description of the present invention will be supplemented by reference to FIGS. 14–16. In these figures the positions of the hot blast outlet is shown relative the center of the stove itself and the combustion chamber. FIG. 14 shows the positioning of the hot blast outlet and its reinforcing wall as was conventional in the prior art. In this figure the blast furnace stove is shown generally at numeral 302, the checker chamber at 304, the combustion chamber at 306 and the partitioning wall between the checker chamber and combustion chamber at 308. A point on the vertical center line of the stove as a whole is shown at 310 and a point on the vertical center line of only the combustion chamber is shown at 312. The hot blast outlet duct 314 extends from the stove and is surrounded by a reinforcing wall 316. The longitudinal horizontal center line of both the hot blast outlet duct and the reinforcing wall is shown at 318. It will be noted that in the prior art this center line passed through the point 312 at the center of the combustion chamber rather than the point 310 at the center of the entire stove. Thus the reinforcing wall 316 was not elliptical in shape but instead was a closed complex curve which required a relatively large number of different refractory shapes to build.

FIG. 15 shows the positioning, relative to the centers of the stove and the combustion chamber, of a radial hot blast stove outlet and a reinforcing wall of the present invention, similar to the one shown in FIGS. 1–3. In this figure a point on the vertical center line of the entire stove is shown at 320 and a point on the vertical center line of the combustion chamber is shown at 322. The radial hot blast outlet duct 324 is surrounded by an elliptically-shaped reinforcing wall 326. It will be seen that the longitudinal horizontal center line of both the elliptically-shaped outlet and the hot blast outlet duct pass through the center of stove at point 320 rather than the center of the combustion chamber at point 322.

FIG. 16 shows the positioning, relative to the centers of the stove and the combustion chamber, of a skewed hot blast stove outlet and a reinforcing wall of the present invention similiar to the one shown in FIGS. 11–13. In this figure a point on the vertical center line of the entire stove is shown at 330 and a point on the vertical center line of the combustion chamber is shown at 332. The skewed hot blast outlet duct 334 is surrounded by an elliptically-shaped reinforcing wall 336. An arrangement such as is shown in FIG. 16 will typically result from the rebuilding of an existing stove. Thus, the longitudinal horizontal center line of the hot blast outlet duct as is shown a numeral 338 will generally pass through point 332 at the center of the combustion chamber. The reinforcing wall 336, however, will be rebuilt from similarly sized bricks in accordance with the present invention, so that it is elliptical in shape and so that its longitudinal horizontal center line 340 passes through point 330 at the center of the stove. It will be understood that the burner inlets and their reinforcing wall on the stoves illustrated in FIGS. 14–16 will preferably be positioned relative to the center points of the stoves and the combustion chambers in the same way as is the hot blast outlet, but for the sake of simplifying these drawings the burner inlets are not shown.

It will , thus, be seen that there is provided a hot blast output or a burner inlet wall which may be constructed from a minimal number of brick shapes and which may be adapted to receive a skewed hot blast output or burner inlet duct. Furthermore, although the invention has been described with a certain degree of particularity, it is to be understood that the present disclosure has been made only as an example and the scope of the invention is defined by what is hereafter claimed.

What is claimed is:

1. In a stove for preheating air to be fed to a blast furnace, having a vertical shell lined internally with refractory brick work, said shell having a burner inlet aperture and hot blast outlet aperture, a partitioning wall extending vertically from a stove base so as to divide said stove internally into a checker chamber containing checkerbrick and a combustion chamber having external fluid communication through said burner inlet and hot blast outlet apertures, an upper means for providing fluid communication between the combustion chamber and the checker chamber, a means for introducing a fuel and air mixture into the combustion chamber through said burner inlet aperture so as to form hot combustion gases, a lower means for exhausting said hot combustion gases from the checker chamber after said combustion gases have passed over the checkerbrick and means for introducing air first into the checker chamber to be preheated by exposure to said checker bricks and then into the combustion chamber to be withdrawn through said hot blast outlet aperture, wherein the improvement comprises an elliptically-shaped refractory wall for peripherally reinforcing the hot blast outlet aperture, said wall having an outer peripheral side abutting the shell, an inner peripheral side adjacent the hot blast outlet aperture, an exterior end facing away from the stove and an interior end interiorly disposed with the respect to the stove and said wall being radially partitioned into a plurality of bricks of approximate dimensional similarity and connected side by side in an elliptically-shaped ring and wherein said elliptically-shaped refractory wall has a longitudinal center line passing through the center of the hot blast aperture and the stove and the combustion chamber each have a vertical center line and the longitudinal horizontal center line of said elliptically-shaped refractory wall intersects the vertical center line of the stove ut not the vertical center line of the combustion chamer.

2. In a stove for preheating air to be fed to a blast urnace, having a vertical shell lined internally with efractory brick work, said shell having a burner inlet perture and hot blast outlet aperture, a partitioning vall extending vertically from a stove base so as to livide said stove internally into a checker chamber ontaining checkerbrick and a combustion chamber aving external fluid communication through said urner inlet and hot blast outlet apertures, an upper neans for providing fluid communication between the ombustion chamber and the checker chamber, a means or introducing a fuel and air mixture into the combusion chamber through said burner inlet aperture so as to orm hot combustion gases, a lower means for exhaustng said hot combustion gases from the checker chamer after said combustion gases have passed over the heckerbrick and means for introducing air first into the hecker chamber to be preheated by exposure to said hecker bricks and then into the combustion chamber to e withdrawn through said hot blast outlet aperture, herein the improvement comprises an elliptically-haped refractory wall for peripherally reinforcing the urner inlet aperture, said wall having an outer periphral side abutting the shell, an inner peripheral side djacent the hot blast outlet aperture, an exterior end acing away from the stove and an interior end interiorly disposed with the repsect to the stove and said wall eing radially partitioned into a plurality of bricks of pproximate dimensional similarity and connected side y side in an elliptically-shaped ring and wherein said lliptically-shaped refractory wall has a longitudinal enter line passing through the center of the burner inlet perture and the stove and the combustion chamber ach have a vertical center line and the longitudinal horizontal center line of said elliptically-shaped refractory wall intersects the vertical center line of the stove but not with the vertical center line of the combustion chamber.

3. The stove as defined in claim 1 wherein the refractory reinforcing wall is flared radially outwardly from said exterior side to said interior side.

4. The stove as defined in claim 1 wherein each of said bricks has an inner peripheral side facing the aperature, an outer peripheral side abutting the shell, an exterior end facing from the stove, an interior end interiorly disposed with respect to the stove, and a pair of lateral a sides abutting adjacent bricks and wherein the lateral sides, of at least some of said bricks, diverge from the inner peripheral side toward the outer peripheral side and from the interior ends toward the exterior end.

5. The stove as defined in claim 4 wherein said bricks having outwardly diverging lateral sides are intersperced with bricks having lateral sides which perpendicularly intersect exterior and interior sides.

6. The stove as defined in claim 1 wherein the refractory wall is vertically bisected into two elliptically-shaped rings connected end to end.

7. The stove as defined in claim 6 wherein each of said elliptically shaped rings is radially partitioned into a plurality of bricks of approximate dimensional similarity.

8. The stove as defined in claim 7 wherein each of said bricks is connected to adjacent bricks by means of tongue and groove joints.

9. The stove as defined in claim 8 wherein each of said bricks has an inner peripheral side facing the aperture, an outer peripheral side abutting the shell, an exterior end facing away from the stove, an interior end interiorly disposed with respect to the stove, and a pair of lateral sides abutting adjacent bricks and wherein the lateral sides, of at least some of said bricks, diverge from the inner peripheral side toward the outer peripheral side and from the interior end toward the exterior end.

10. The stove as defined in claim 9 wherein said bricks having outwardly diverging lateral sides are intersperced with bricks having lateral sides which perpendicularly intersect their exterior and interior sides.

11. The stove as defined in claim 1 wherein an exterior cylindrical fluid conveying duct projects from the hot blast outlet aperture.

12. The stove as defined in claim 11 wherein the duct has an inner layer of refractory material and a outer metal jacket concentric which said inner refractory layer and one or more layers of insulating material concentric with and interposed between said inner refractory layer and said outer metal jacket.

13. The stove as defined in claim 11 wherein the exterior cylindrical fluid conveying duct projects radially from the stove.

14. The stove as defined in claim 11 wherein the exterior cylindrical fluid conveying duct projects from the stove at an acute angle.

15. The stove as defined in claim 9 wherein the exterior cylindrical fluid conveying duct abuts the exterior end of the refractory reinforcing wall.

16. The stove as defined in claim 15 wherein the exterior cylindrical fluid conveying duct perpendicularly abuts the exterior end of the refractory reinforcing wall.

17. The stove as defined in claim 15 wherein the exterior cylindrical fluid conveying duct abuts the exterior end of the refractory reinforcing wall at an acute angle.

18. The stove as defined in claim 1 wherein the elliptically-shaped refractory wall has a horizontal center line passing through the center of the hot blast aperture and the stove has a vertical center line and said longitudinal horizontal center line of the refractory wall and said vertical center line of the stove intersect and wherein the fluid conveying duct has a longitudinal, horizontal center line and the combustion chamber has a vertical combustion chamber and said longitudinal horizontal center line of the duct and the vertical center line of the combustion chamber intersect.

* * * * *